US009435098B1

(12) United States Patent
Esrafili

(10) Patent No.: US 9,435,098 B1
(45) Date of Patent: Sep. 6, 2016

(54) FLOATING PRECAST MANHOLE AND CATCH BASIN COVER SYSTEMS

(71) Applicant: Esmaeil Esrafili, Richmond Hill (CA)

(72) Inventor: Esmaeil Esrafili, Richmond Hill (CA)

( * ) Notice: Subject to any disclaimer, the term of this patent is extended or adjusted under 35 U.S.C. 154(b) by 0 days.

(21) Appl. No.: 14/921,450

(22) Filed: Oct. 23, 2015

Related U.S. Application Data

(60) Provisional application No. 62/164,419, filed on May 20, 2015.

(51) Int. Cl.
*E02D 29/14* (2006.01)

(52) U.S. Cl.
CPC ..... *E02D 29/1409* (2013.01)

(58) Field of Classification Search
CPC .. E02D 29/14; E02D 29/1409; E02D 29/149
See application file for complete search history.

(56) References Cited

U.S. PATENT DOCUMENTS 2,358,750 A * 9/1944 Walker ..... E02D 29/14 404/25
3,218,943 A * 11/1965 Bowman ..... E02D 29/1409 220/3.7
3,250,190 A * 5/1966 Taylor ..... E02D 29/14 404/25
4,050,839 A * 9/1977 Vollmar ..... E02D 29/1409 210/163
4,158,515 A * 6/1979 Helms ..... E02D 29/121 210/164
4,449,715 A * 5/1984 Gagas ..... F16J 15/021 277/625
4,666,333 A * 5/1987 Armstrong ..... E02D 29/14 404/25
4,927,290 A * 5/1990 Bowman ..... E02D 29/14 404/26
5,934,820 A * 8/1999 Hinkle ..... E02D 29/1409 249/188
6,371,688 B1 * 4/2002 Yang ..... E02D 29/1409 404/25
6,953,302 B1 * 10/2005 Kochling ..... E02D 29/121 404/26
2007/0116518 A1 * 5/2007 Tortorici ..... E02D 29/14 404/25
2008/0168727 A1 * 7/2008 Ledford ..... E02D 29/14 52/302.3
2010/0124458 A1 * 5/2010 Munro ..... E02D 29/12 404/26
2012/0297691 A1 * 11/2012 Gaspar ..... E02D 29/14 49/505
2013/0312338 A1 * 11/2013 Gaspar ..... E02D 29/12 52/19
2014/0026491 A1 * 1/2014 Gumbley ..... E02D 29/14 49/505
2014/0250794 A1 * 9/2014 Reynolds ..... E02D 29/1409 49/504

* cited by examiner

*Primary Examiner* — Abigail A Risic
(74) *Attorney, Agent, or Firm* — Nasser Ashgriz; UIPatent Inc

(57) ABSTRACT

A floating manhole cover system to be installed on a manhole shaft and a road base. The system comprising a precast ring having an inner diameter sized to align with the inner diameter of the manhole shaft; an outer diameter being larger than the outer diameter of the manhole shaft; a top surface to engage with the road top finish (asphalt or concrete); a bottom surface to engage with the road base through cast in place concrete and to allow the precast-ring to move with a heave action of the road base and road. The system further having a manhole cover receiving means casted in to receive a manhole cover, and a leveling means casted in to engage with the manhole shaft to level said precast-ring with the road.

15 Claims, 10 Drawing Sheets

FLOATING PRECAST MANHOLE AND CATCH BASIN COVER SYSTEMS

RELATED APPLICATION

The present application claims the priority date of a provisional patent application No. 62/164,419 filed on May 20, 2015.

FIELD OF THE INVENTION

The present invention relates in general to civil infrastructure, sewer and storm water systems and especially to manhole and catch basin cover installation systems.

BACKGROUND OF THE INVENTION

Since the invention of underground sewer system over a century ago, engineers and inventors have been trying to solve the problems related to the manhole cover failure. These problems include: (1) manhole cover ring support failure (mortar); (2) inflow and infiltration (I/I) of storm and underground water into the manhole; (3) rising road surface due to the freeze/frost and heave action; (4) raising manhole cover due to resurfacing the road asphalt; and (5) challenges in practically adjusting the manhole cover according to the road slope.

Manhole cover failure is a significant financial burden on the municipalities. In order to have proper flow of traffic, it is necessary to re-level the manhole cover with the road. Since the municipalities' specification, in general, do not provide an engineered direction on how to adjust the manhole cover slope according to the road slope, many issues arise after the installation. The specifications do not provide proper means of levelling the manhole cover ring and its adjustment to the slope of the road. The specified mortar connection cannot be engineered to resist the AASHTO (American Association of State Highway and Transportation Officials) specified traffic load. In addition, the current mortar connection does not allow for proper design of the connection to stabilize manhole cover ring. Therefore, it naturally ends up failing under traffic load, as the grading rings rupture and fall apart causing the manhole ring to drop down and become a traffic hazard.

The manhole cover ring is usually placed on the top of the last manhole shaft piece (tapered section). Since the manhole shaft bottom is below the freeze and frost depth, the shaft is not subject to heave action. Therefore when the road surface is lifted up due to the winter heave the manhole cover does not rise with the road surface, since it is placed on top of the manhole shaft.

Since the waste water sewer is warm, and also the manhole shaft is not insulated at the freezing depth, the generated warm air penetrates through the manhole shaft wall to the immediate surrounding soil and the road base, causing the surrounding soil not to heave and not to rise with the road surface.

When the mortar holding the manhole cover ring fails, and the surrounding asphalt rises, the asphalt surrounding the manhole cover ruptures. Since the manhole shaft, which receives the manhole cover ring, is not water and air tight, it allows the water to flow toward a low point, namely the manhole. Water, eventually, finds a way to seepage toward the shaft, and on the way washes out the road base fine particles and loosens the road base. This expedites the manhole cover and surrounding asphalt failure.

Usually roads have two directional slopes, one slope (in general 2%) toward the side to carry the rain and storm water toward the curb and another slope longitudinally in the road direction, called uphill or downhill slope. In order for the manhole cover to be installed perfectly, it should be set according to the above two slopes. Otherwise the manhole cover will not match with the road surface, and the edges of the manhole ring will be either higher or lower than the road final level, which creates traffic issues.

The currently available systems to level the manhole cover with the road slope lack proper installation system at all stages of the road construction, including: at a new road construction; at resurfacing stage; during overlaying a new layer on the top of the old one; at the stage of repaving the existing failed manhole; during replacing of the top layer of asphalt; and when repairing the existing manhole cover.

The prior arts related to the manhole cover has tried to resolve some of the issues discussed above. However, none have been able to solve all issues. Most have tried to find a way to raise a manhole cover that has fallen below the road surface. The prior art has not addressed the issue that the manhole cover ring is fixed on the top of a manhole shaft which does not move, while the surrounding road material moves up and down due to the heave action. The prior art also discloses methods to level the manhole cover, and tries to stop the inflow and infiltration (I/I) to the sewer system through manhole.

The prior art, however, does not consider the complex interrelation between the heaving action, the road level and a fixed manhole shaft. The main issue of the prior arts is that they do not consider the heave action of the road surface, and that the road asphalt heaves around the poured concrete. In addition, its reinforcing is not properly engineered and does not include shear reinforcement. In addition, the prior art manhole covers do not provide the option of asphalt topping to match the asphalt finished road. And finally if the road is resurfaced the manhole cover ring cannot be raised since it is casted in the poured concrete. The self-leveling manhole covers perform self-levelling only during the installation process and ignore the heave effect of the road surface, which alters the original leveling after one season. Also these systems are practically very difficult to install.

In general, all of the prior arts have one major common character, namely that they place and fix the manhole cover ring on the manhole shaft top. Manhole shaft is a fixed point and when the road heaves the manhole cover, even if it does not fail, stays below the road level and becomes a pothole.

The present invention provides a floating manhole cover that moves with the heave action of the road. It is a sustainable and cost effective engineered solution that will eliminate regular manhole cover repairs, saving municipalities a significant amount of money. It also increases public safety by providing a better traffic flow and smoother road surface. It also reduces vehicle alignment damage and repair cost.

SUMMARY OF THE INVENTION

The present invention is a Floating Pre-cast Ring (FPR) that is designed and engineered to solve the problems that cause the manhole cover to fail.

The Floating Pre-cast Ring (FPR) is a precast concrete ring that sits on the road base and transfers the manhole cover load to the road base. The FPR is a precast and armored concrete ring that has an inner diameter which is the same size as the inner diameter of the manhole shaft. However, the outer diameter of the ring is much larger than the manhole shaft diameter causing the FPR to sit on the soil surrounding the shaft. Therefore, the FPR moves with the heaving action of the soil and the road, moving the manhole cover with it. The FPR has a plurality of leveling legs, which are designed to sit on the manhole shaft. During the installation, the legs are adjusted to level the FPR with the slope of the road. However, after the installation, the FPR is free to move with the heave action of the road, keeping the manhole cover in the same level and at the same slope as the road.

In the preferred embodiment, the legs have threaded rods that can be accessed from the top of the FPR for height adjustment. Once the FPR is set and aligned, fresh concrete is poured around it to fill the gap between the FPR and the road. The poured filling concrete is separated from the shaft wall by placing a membrane to stop the concrete to flow to the top of the shaft and into the shaft.

In order to removably install the manhole cover on the FPR, a manhole cover ring, preferably made of cast iron, is bolted onto the top surface of the precast concrete ring from the top. A plurality of couplers is embedded in the FPR in order to fasten the manhole cover ring. The manhole cover ring is then bolted to the couplers. This type of connection between the manhole cover ring and the precast concrete ring allows for a precise engineered design of the entire subjected load from the vehicle on the road based on the AASHTO specified loads.

In the preferred embodiment of the present invention, the FPR extends at least 250 mm beyond the outside diameter of the manhole shaft. Therefore, the FPR sits on the freshly poured concrete that fills the gap between the precast ring and the road base, and not on the manhole shaft. The system will take all of the loads imposed on the manhole cover and transfers it to the precast ring, which then transfers the load to the road base, which is already designed to handle such loads by the original road design.

The gap between the precast concrete ring and the manhole shaft is covered by an expandable (accordion shape) rubber gasket. This gasket is tightly fastened to the FPR at its top and to the shaft at its bottom by using two circular clamps. By closing the gap with this rubber gasket an air tight shaft is created and the warm air and sewer odor generated from the sewer is not exerted to the surrounding soil. In the severe cold regions, before the rubber gasket is installed, the gap is insulated by a foam spray or a membrane to stop heat exchange between the shaft and the surrounding soil. This fully utilizes the heave action in raising the manhole cover together with the road surface.

Bentonite water stop tape or other proper sealant will be placed on the top of FPR where the manhole cover ring sits before placing the manhole cover ring on the FPR, to make the connection water proof and then fasten the connection bolts.

Also, placing the rubber gasket between the precast concrete ring and the manhole shaft top will water tight the gap and eliminate the water inflow to the shaft if any. And by stopping the water inflow the surrounding road base becomes stabilized and creates a sustainable condition for the system to last.

One object of the present invention is to provide a manhole cover that is easy to install and align according to the slope of the road. The present FPR allows for such alignment by simply turning several legs for a precise slope and leveling adjustment.

Another object of the present invention is to provide a manhole cover system that can last for long time and does not lose its alignment with respect to the road. The present Floating Pre-cast Ring (FPR) is capable of being installed and maintained with all its integrity in all stages of the road.

Other objects, features, and advantages of the present invention will be readily appreciated from the following description. The description makes reference to the accompanying drawings, which are provided for illustration of the preferred embodiment. However, such embodiments do not represent the full scope of the present invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

DETAILED DESCRIPTION OF PREFERRED EMBODIMENTS

Figure 1:
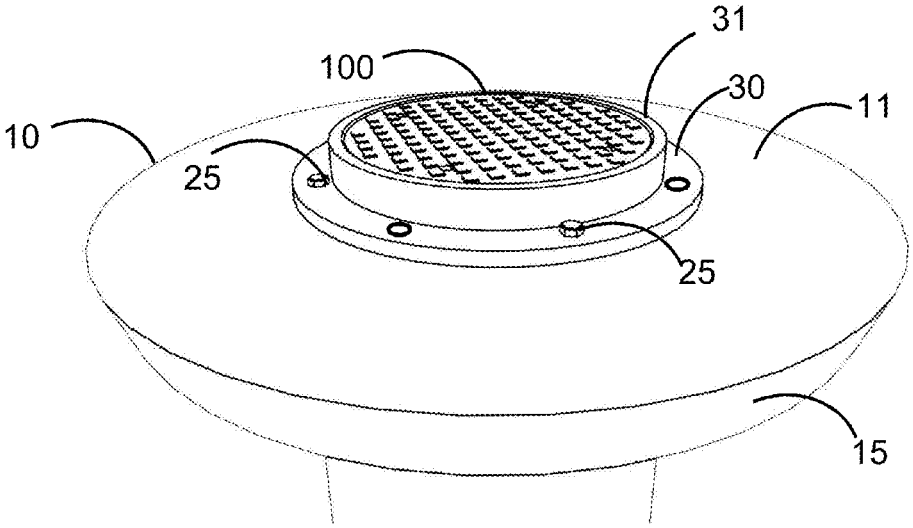
FIG. 1 shows a top perspective view of the present invention installed on a manhole shaft.

As shown in FIGS. 1-6, a floating precast ring (FPR) 10 comprises of a floating ring 10 having an inner diameter, an outer diameter, a top surface 11 and a bottom surface 12. The inner diameter of the precast ring is sized to align with the inner diameter of a manhole shaft 50. The outer diameter of the FPR is much larger than the manhole shaft, providing a large surface area underneath the FPR which engages with the road base through the cast-in-place-concrete. The side walls 15 of the precast ring are angled outwardly, having a larger upper diameter and smaller lower diameter. The FPR has a set of levelling legs 40 which are used to level the floating ring 10 with the road.

The FPR has means to receive a manhole cover 100. In the preferred embodiment, the means to receive the manhole cover comprise of a plurality of couplers 20 embedded inside the FPR during the precast. The couplers 20 are threaded on their inner walls. Then a manhole cover ring 30, preferably made of cast iron, is attached to the FPR 10 with a set of bolts 25, which secure the manhole cover ring 30 to the couplers 20. Then the manhole cover 100 can be set on the manhole cover ring. The manhole cover ring has a recess 31 to receive a manhole cover 100.

One advantage of the present invention is that the floating ring 10 is a precast ring made of concrete, which is produced by precast manufacturing in a reusable mold and transported to the construction site and lifted into the manhole shaft. The FPR can also be made of other material (other than concrete) such as Fiber Reinforced Plastic (FRP), which can be made to have has enough strength to handle the road load.

In the preferred embodiment of the present device, the floating ring 10 is made of concrete and is precisely designed for the entire subjected load from the vehicle on the road based on the AASHTO specified loads. The FPR is armored with steel rods 18 and shear reinforcing 19, which are sized and put in proper number and spacings to handle the road load. The configuration and location of the steel rods 18 embedded inside the floating ring 10 is variable based on the different road loads.

Figure 2:
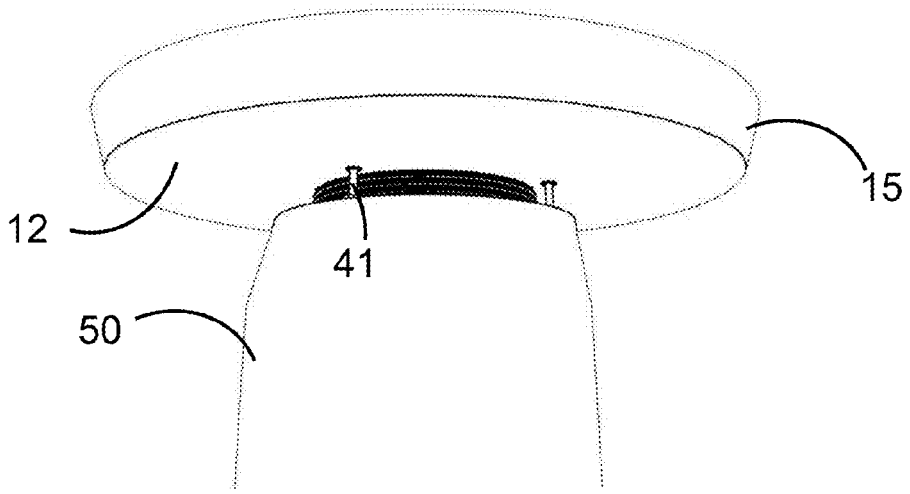
FIG. 2 shows a bottom perspective view of the present invention installed on a manhole shaft with leveling means.
Figure 3:
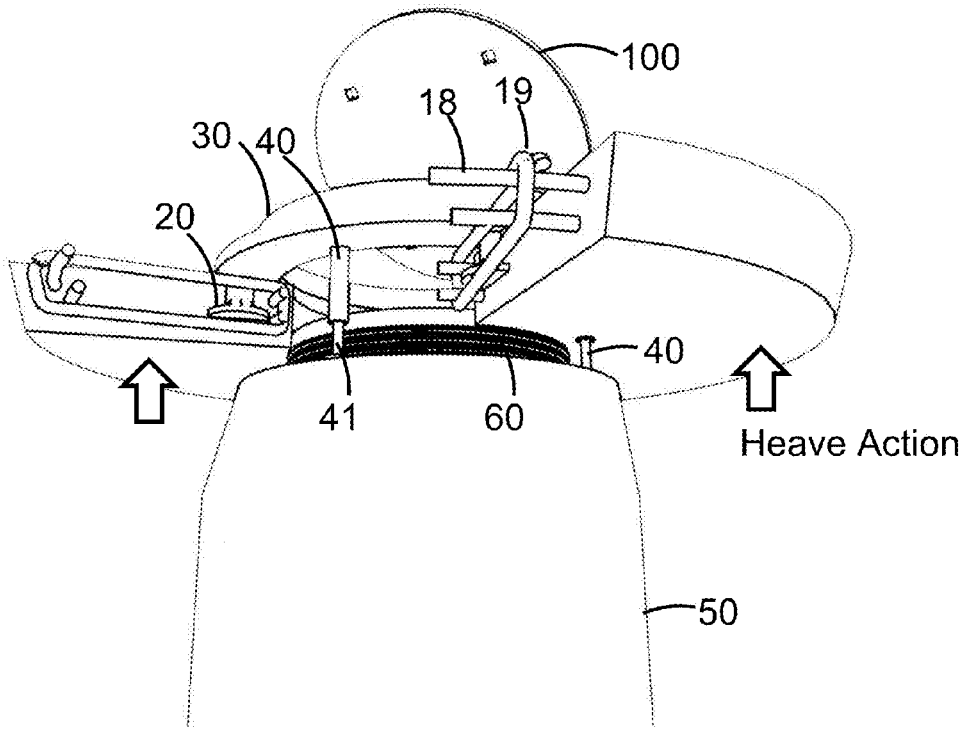
FIG. 3 shows a perspective view of the present invention installed on a manhole shaft with a section of the precast removed showing the armored inside.
Figure 4:
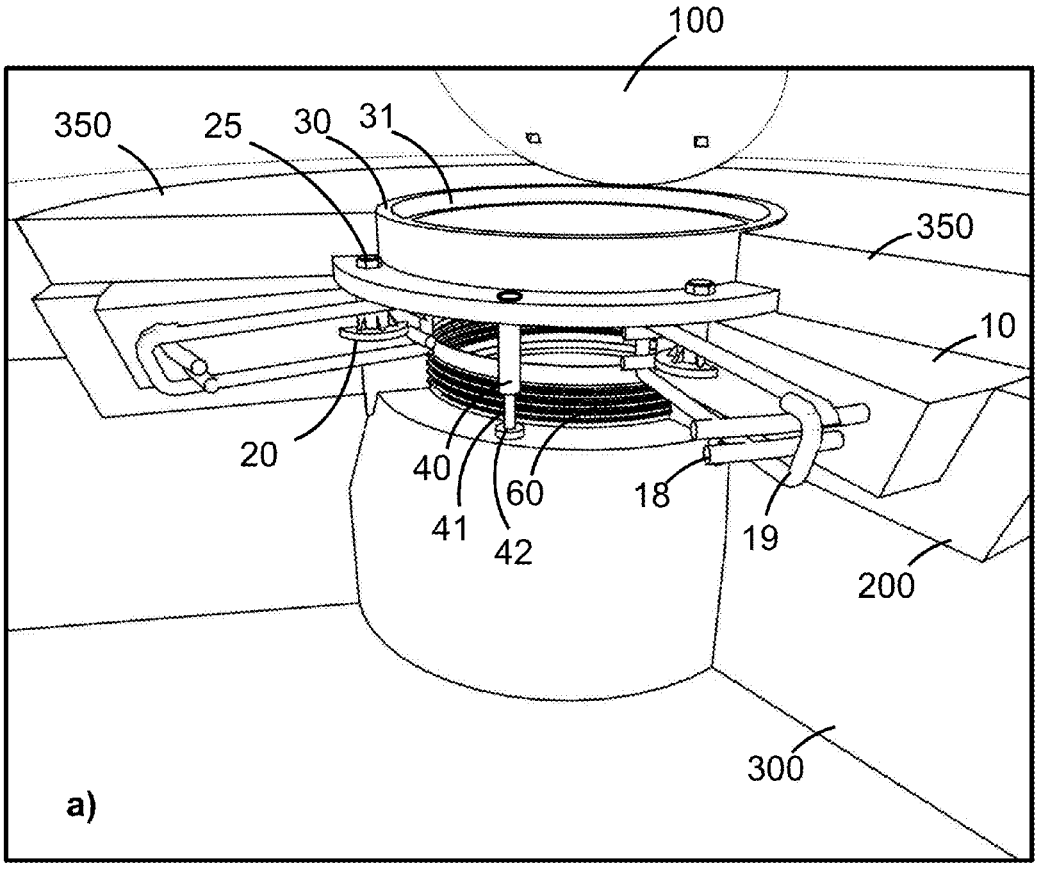
FIG. 4 (*a-b*) a) shows a perspective view of the present invention installed on a manhole shaft and a cross section view of a floating precast ring engaged with the road base and asphalt, b) shows a leveling means.
Figure 4:
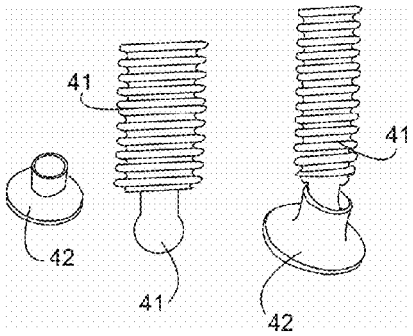
Figure 5:
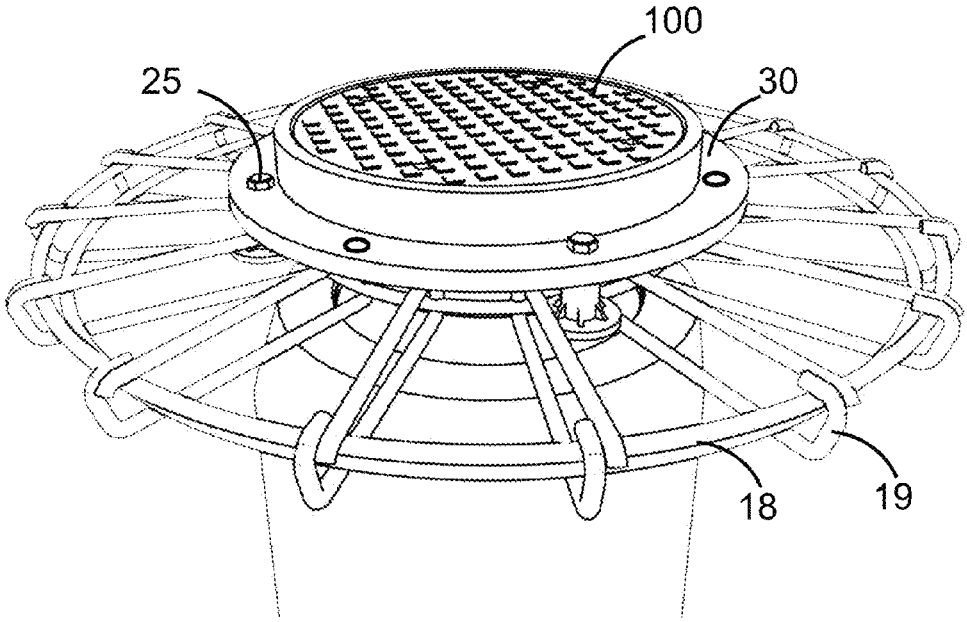
FIG. 5 shows the armored inside the precast and the manhole cover ring.

As shown in FIGS. 2, 3 and 4 (*a-b*), the means to level the floating ring 10 with a road surface is a plurality of leveling legs 40 extending through the floating ring 10 and engaging with the top surface of the manhole shaft 50. The length of each leg 40 can be adjusted by a leveling rod 41. The manhole cover 100 is leveled by increasing and decreasing the length of the leveling rods 41 simply by turning them.

As shown in FIG. 4, each leveling leg 41 is in swivel connection with the head 42. By turning the bolt 41, the head 42 is attached to the end 41 of the leveling ring to minimize the friction at the tip of the leveling bolts 41.

Again as shown in FIGS. 1-6, the Floating Pre-cast Ring (FPR) 10 is especially engineered to lift the manhole cover with a road heave. The FPR 10 has a larger diameter than the manhole shaft 50. The outer diameter of FPR 10 is at least 500 cm (250 cm on each side) larger than that of the shaft 50 outer diameter. This diameter can be engineered and changed based on the local road heave actions. After leveling the FPR 10, the created gap in between the FPR 10 and the road base is filled by fresh concrete 200 which further supports the FPR 10. The preferred gap between the FPR 10 and road base is 100 mm. The upward forces due to the heave are transferred to the FPR 10 and move it upwards with the road heave. Therefore, the manhole is always in level with the road.

Figure 6:
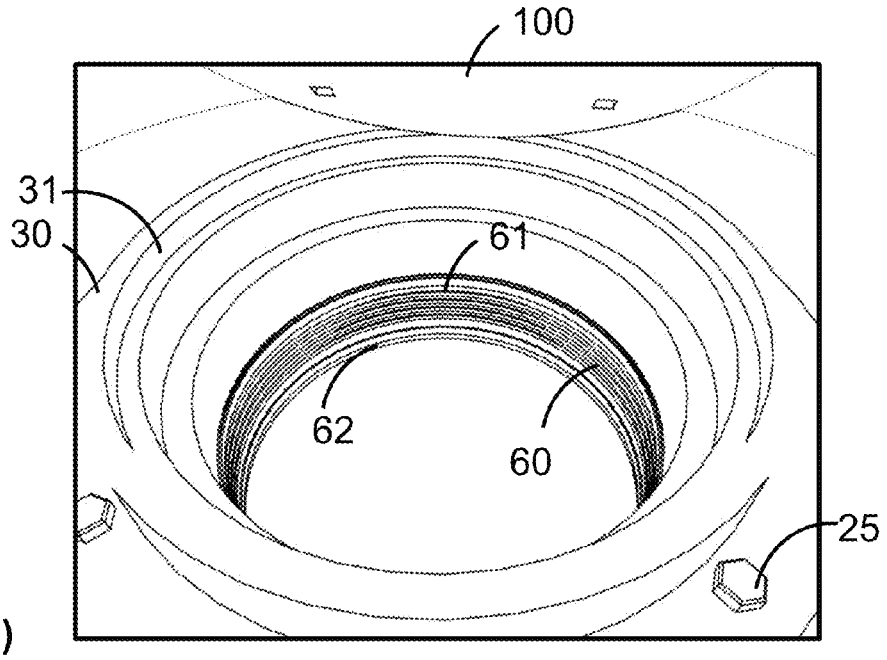
FIG. 6 (*a-b*) show the top view of the manhole cover with manhole cover removed showing the insulation coupling between the precast and the manhole shaft.
Figure 6:
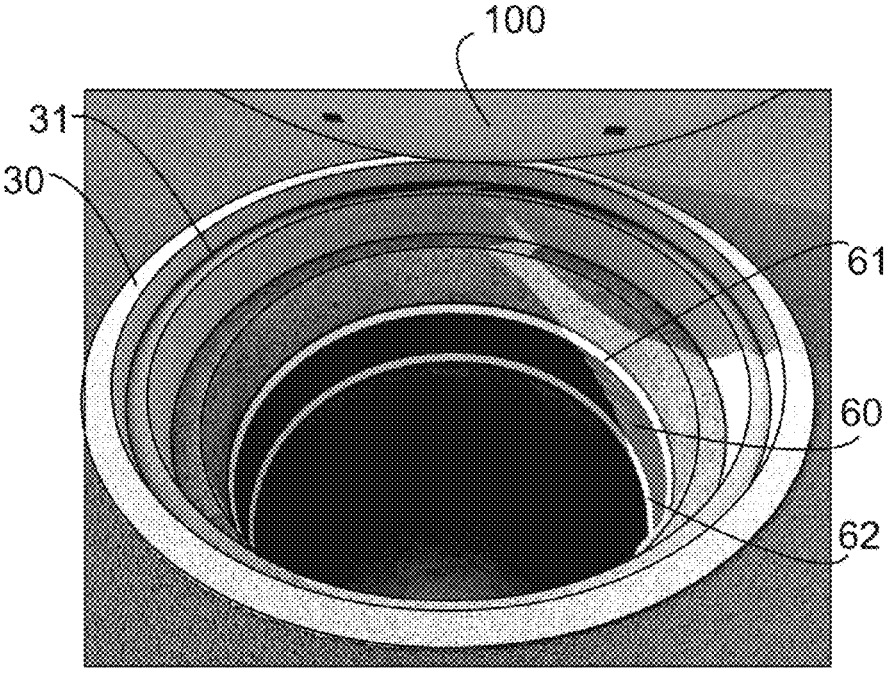
Figure 7:
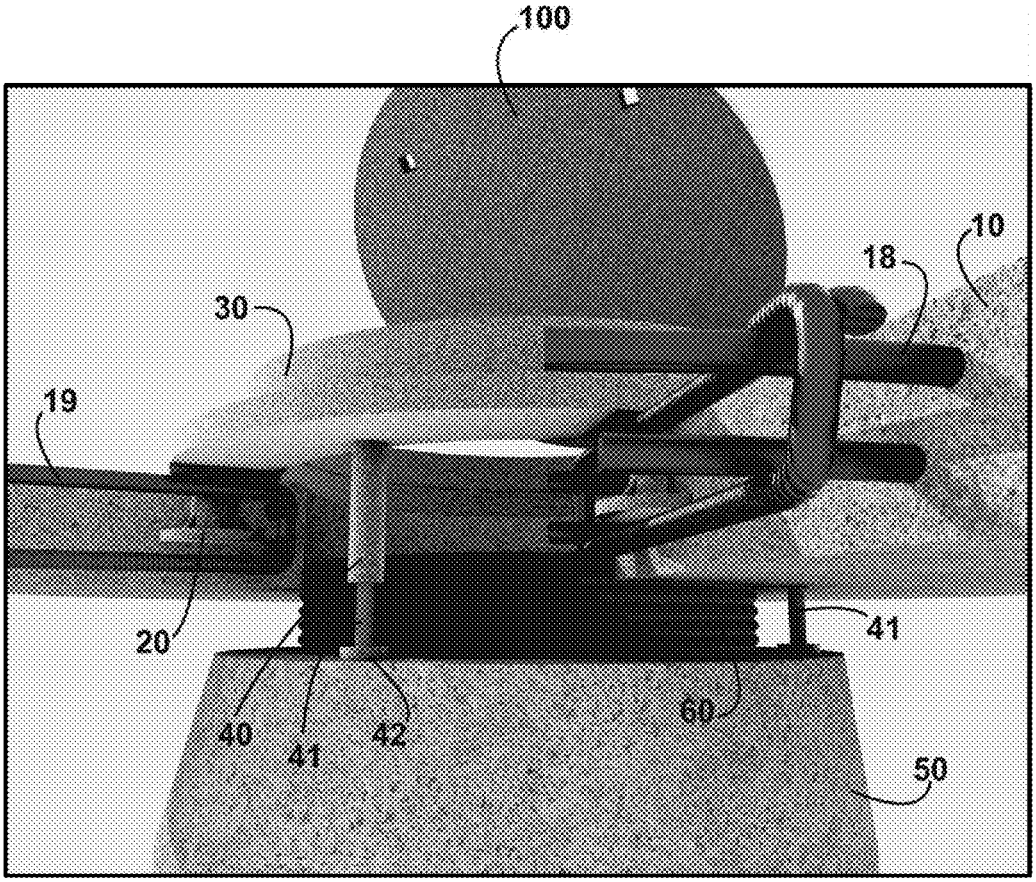
FIG. 7 shows a perspective view of the present invention installed on a manhole shaft and a cross section view of a floating pre-cast ring.
Figure 8:
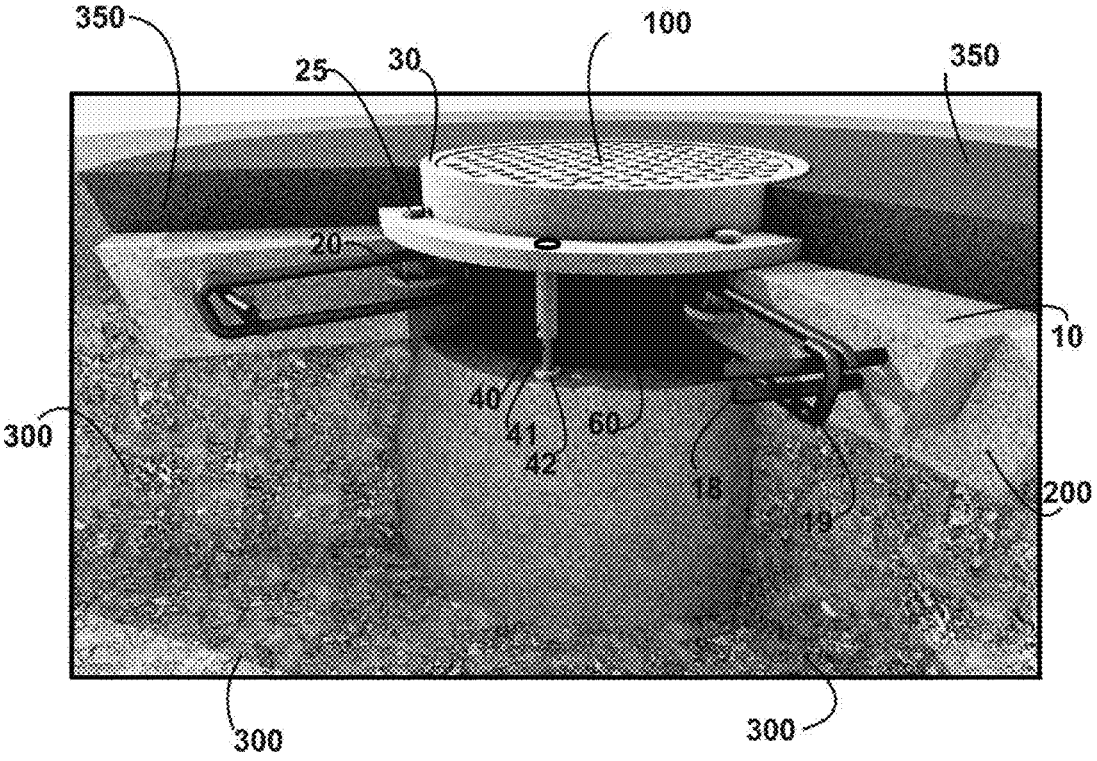
FIG. 8 shows a perspective view of the present invention installed on a manhole shaft and a cross section view of a floating pre-cast ring with the area surrounding the manhole shaft.

As shown in FIGS. 6-8, the present invention further comprises of an expandable (accordion shape) rubber gasket 60 installed between the FPR 10 and the secondary shaft 50. This gasket is tightly fastened by circular clamps at the top 61 and the bottom 62 to FPR 10 and the shaft sealing the gap between them. This rubber gasket 60 makes the shaft 50 air tight, preventing the warm air and sewer odor generated from the sewer to enter into the surrounding soil 300. In severe cold regions, it is preferred to insulate the gap 80 before the rubber gasket 60 is installed. Different types of insulations, such as a foam spray or a membrane type can be used to stop the heat exchange between the shaft 50 and the surrounding soil 300.

The present invention takes all the loads imposed on the manhole cover 100 and the load of the precast ring 10 from the shaft 50 and transfers the load through the FPR 10 and Cast-In-Place concrete to the road base, which has already been designed to handle this load by road design. The poured filling concrete 200 will be separated from the shaft wall 50 by a membrane.

The following is the preferred method for installing the manhole cover of the present invention on a manhole shaft. The method comprises of the following steps:

a. cutting around the manhole shaft 50 using a circular extractor with a required distance from the edges of a manhole cover ring 30, and exposing the top of the manhole shaft wall 50 and exposing a road base;
b. compacting the exposed road base 300 around the manhole shaft wall 50;
c. cutting an insulation membrane to a predetermined height and placing it around the exposed manhole shaft wall 50;
d. placing a precast ring 10 using a lifter or a bobcat on top of the manhole shaft so that the bottom ends of the levelling bolts 41 sit on top of the manhole shaft wall 50;
e. leveling the top of the manhole cover ring 30 with the road top level and slope of the road in two direction, by turning the levelling bolts 41 which is accessible from the top—the leveling can be performed accurately with high precision by turning the bolts from the top;
f. filling the gap between the road base 300 and FPR 10 with a fresh cast in place concrete 200 up to the top of the pre-cast concrete ring 10—if the road finish is concrete the cast-in-concrete can be poured up to the road top and if the road finish is asphalt, the concrete is poured to the top level of the pre-cast ring 30—and after concrete is cured and hardened, place the finishing asphalt 350 the next day;
g. insulating the gap between the bottom of the pre-cast concrete ring 10 and the top of the manhole shaft wall 50 using insulating foam spray or insulation membranes; and
h. installing an accordion shape rubber gasket 60 with two ring clamps 61 and 62 inside the manhole and make the manhole system water tight and air tight.

The precise level and slope of the road can be visually obtained by simply using tight strings or placing a levelling long steel in the direction of the road slops while raising the pre-cast concrete ring. As the top of the manhole ring touches the string, the ring is adjust. This process is repeated until all four sides of the ring are adjusted.

Foam insulation can be used instead of insulation membranes, therefore, there is no need to have precut insulations ready before installing the manhole cover ring. The insulation between the manhole shaft and the surrounding soil can also be a sandwich type insulation section attached to the precast concrete shaft segment on the top portion to prevent heat exchange and to utilize the heave action in full to raise the precast concrete ring.

Figure 9:
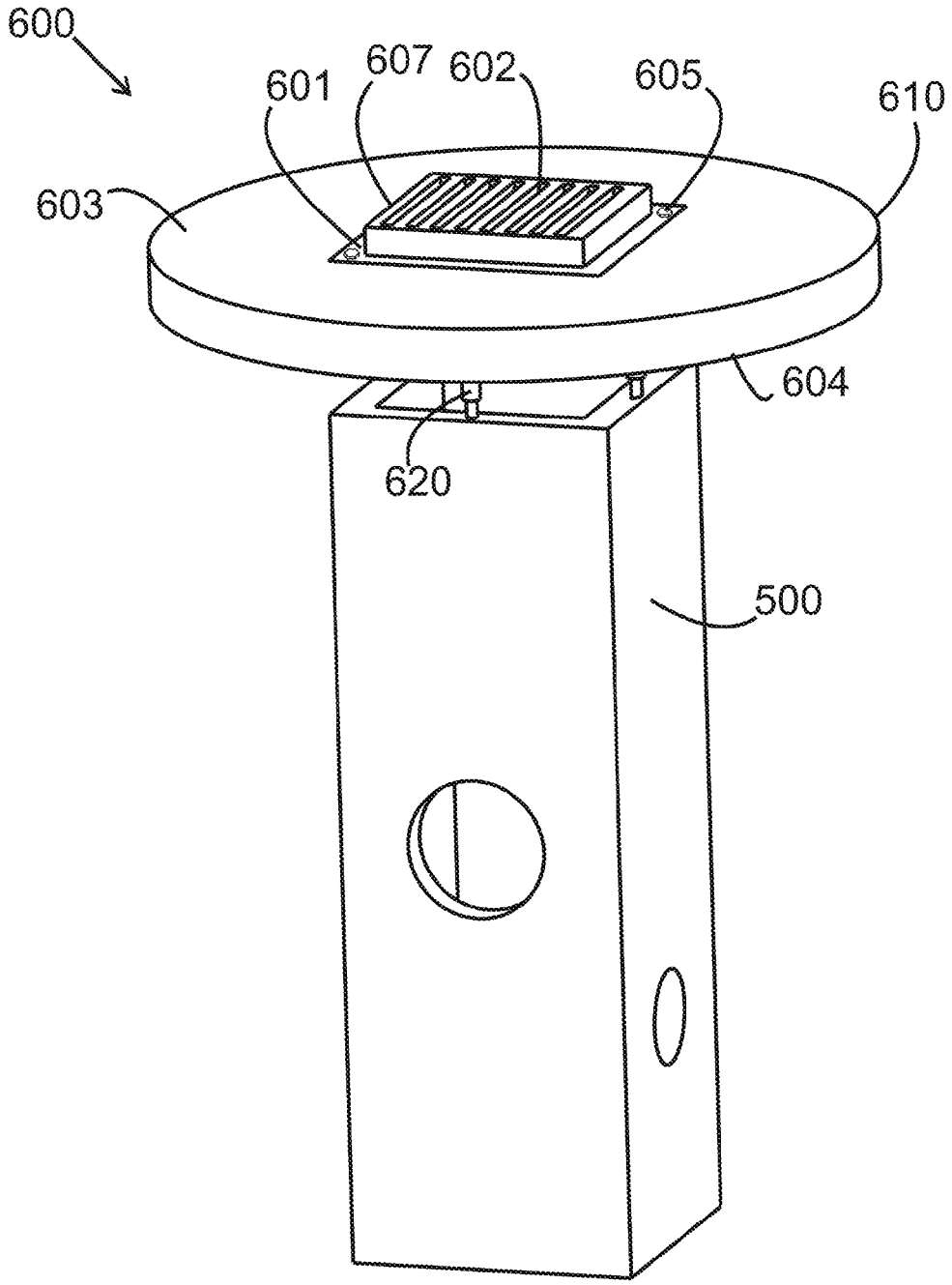
FIG. 9 shows a perspective view of a floating catch basin cover system of the present invention installed on storm water catch basin.
Figure 10:
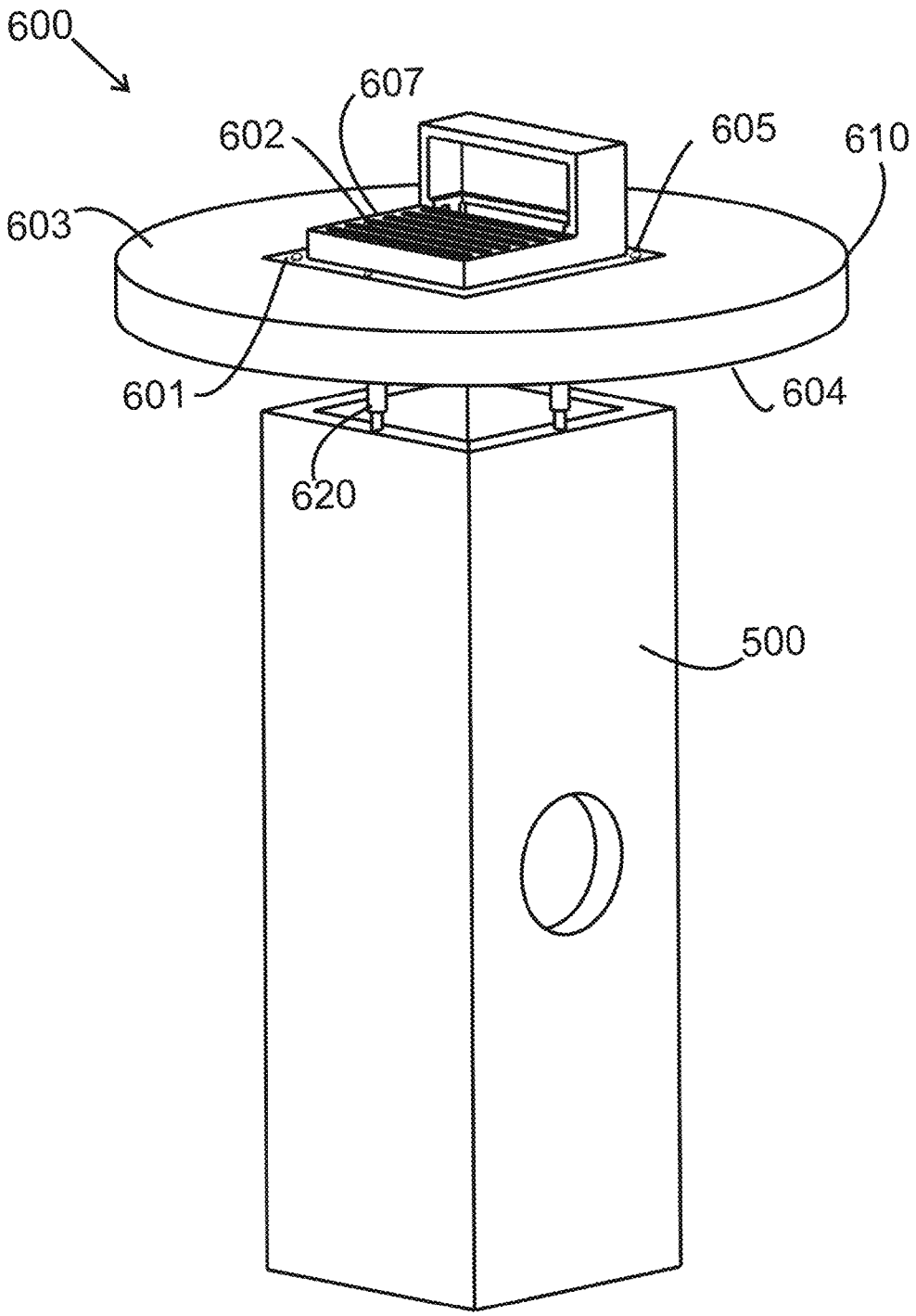
FIG. 10 shows a perspective view of a floating catch basin cover system of the present invention installed on storm water catch basin.

As shown in FIGS. 9-10, another embodiment of the present invention is a floating catch basin cover system 600 that is designed and engineered to be installed on storm water catch basins 500. In these systems a cast iron cube 601 is bolted 605 to the precast concrete ring 610 by four heavy duty bolts 605-606 and coupler that are built inside the catch basin cover 610. The couplers are threaded on their inner walls. Then a cast iron cube 601 is attached to the precast concrete ring 610 with a set of bolts 605-606, which secure the cast iron cube 601 to the couplers. Then the catch basin cover 602 can be set on precast concrete ring 610. The precast concrete ring 610 has a recess 607 to receive the catch basin cover 602.

A floating catch basin cover system 600 is installed on a catch basin shaft 500 and a road base. The system 600 comprises of a precast ring 610 having an inner dimension sized to align with the inner dimension of the catch basin shaft 500; an outer dimension being larger than the outer dimension of the catch basin shaft 500; a top surface 603 to engage with the road; a bottom surface 604 to engage with the road base and to allow the precast ring 610 to move with a heave action of the road base and a road; a catch basin cover 602 receiving means attached to the top surface 603 to receive a catch basin cover 602, and a leveling means attached to the bottom surface 604 to engage with the catch basin shaft 500 to level the precast ring with the road.

The precast concrete ring 610 extends the cover outside dimensions by at least 250 mm. Therefore, instead of the cover sitting on top of the shaft 500, it sits on the freshly poured concrete that fills the gap between the precast catch basin 610 and the road base. The system 600 will take all the loads imposed on the sewer cover and the load of the precast ring 610 from the shaft top 500 and transfers the load to the road base which has already been designed to handle this load by road design.

The installation, concept and details for the catch basin inlet section are the same as the floating manhole cover.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. A floating manhole cover system to be installed on a manhole shaft having an inner opening, and an outer diameter, and a road having a road base, said system comprising:

a. a precast-ring having an inner diameter sized to align with the inner diameter of the manhole shaft; an outer diameter being at least 25cm larger than the outer diameter of the manhole shaft; a top surface to engage with the road's top finish; a bottom surface to engage with the road base through a cast-in-place-concrete;

b. a manhole cover receiving means to receive a manhole cover;

c. a leveling means accessible from the top surface and extending out of said bottom surface to engage with but not attached to the manhole shaft to level and adjust the slope of said precast-ring with the road, wherein said leveling means provides a gap between said precast-ring and said manhole shaft;

d. a sealing tube placed in said gap, wherein said sealing tube having a top end to attach to said precast-ring, and a bottom end to attach to said manhole-shaft, thereby preventing flow of any gases out of the manhole-shaft and inflow of surface rain water and underground water into the manhole-shaft, whereby said precast-ring is independent of said manhole shaft and moves with a heave action of the road and the road base.

2. The floating manhole cover system of claim 1, wherein said manhole cover receiving means comprising:

a. a plurality of receiving couplers casted and embedded inside said precast-ring, and b. a manhole-cover-ring having a recess to receive said manhole-cover, said manhole-cover-ring having apertures to receive a plurality of bolts, wherein said bolts engage with said plurality of couplers embedded inside said precast-ring to secure said manhole-cover-ring on said precast-ring.

3. The manhole cover system of claim 1, wherein said leveling means comprising a plurality of adjustable length leveling legs that extend through the bottom surface of the precast-ring and are aligned to sit on the manhole shaft, thereby, the heights of said legs are adjusted to align and level the manhole-cover with the level and the slope of the road.

4. The floating manhole cover of claim 1, wherein said floating precast-ring is made of a precast concrete.

5. The floating manhole cover of claim 1, wherein said floating precast-ring is made of a fiber reinforced plastic.

6. The floating manhole cover of claim 1, wherein said floating ring is armored with steel rods.

7. The floating manhole cover of claim 1, wherein said sealing tube is an accordion shape rubber gasket having clamping means to attach to said precast-ring and to said manhole-shaft, thereby the height of said gasket changes with the heave action of the road.

8. The floating manhole cover of claim 1, further having an insulating means to insulate said gap between the manhole-shaft and the floating precast-ring.

9. The floating manhole cover of claim 8, wherein said means to insulate the gap between the manhole-shaft and the floating precast-ring is an insulating foam spray or an insulation membrane.

10. The floating manhole cover of claim 1, wherein said precast-ring is cylindrical.

11. The floating manhole cover of claim 10, wherein said outer diameter of said floating precast-ring is at least 50 cm larger than the outer diameter of the manhole-shaft.

12. The floating manhole cover of claim 1, wherein said precast-ring has a circular outer shape and has a square or a rectangular inner opening.

13. A floating catch basin cover system to be installed on a catch basin shaft having an inner opening and an outer diameter, and a road base, said system comprising:

a. a precast-ring having a square or a circular inner opening to align with the inner opening of the catch basin; an outer diameter being at least 25 cm larger than the outer diameter of the catch basin; a top surface to engage with the road's top finish; a bottom surface to engage with the road base through a cast-in-place concrete;

b. a catch basin cover receiving means casted in the precast-ring to receive a catch basin cover frame;

c. a leveling means accessible from the top surface and extending out of said bottom surface to engage with but not attached to the catch basin to level and adjust the level and slop of the precast-ring with the road wherein said leveling means provides a gap between said precast-ring and said catch basin;

d. a sealing tube placed in said gap, wherein said sealing tube having a top end to attach to said precast-ring and a bottom end to attach to said catch basin, thereby preventing flow of any gases out of the catch basin and inflow of surface rain water and underground water into the catch basin, wherein said gap between the bottom of the precast-ring and the top of the catch basin is sealed with an insulating spray foam, whereby said precast-ring is independent of said catch basin and moves with respect to the heave action of the road and the road base.

14. A method of installing a manhole cover, comprising:

a. obtaining a floating precast manhole cover system having a manhole-cover-ring, a precast-ring, a set of leveling legs;

b. cutting around a manhole-shaft to a predetermined distance from the edge of the manhole-cover-ring using a circular extractor, and exposing the top of a manhole shaft wall;

c. obtaining an insulation membrane with a predetermined size and placing said insulation around the manhole-shaft wall;

d. compacting an exposed road base around the manhole shaft wall;

e. placing said precast-ring on top of the manhole using a lifter so that the levelling legs sit on top of the manhole shaft wall;

f. leveling the top of the manhole cover ring with the road top level and slope of the road in two direction, by adjusting the height of the levelling legs;

g. filling a gap between the road base and the precast ring with a fresh cast-in-place-concrete up to the top of the precast ring;

h. insulating a gap between the bottom of the precast ring and the top of the manhole shaft wall using an insulating spray or an insulation membranes; and i. installing an accordion shape rubber gasket between said precast-ring and said manhole-shaft using clamping means to secure and seal said gasket.

15. The method of installing a manhole cover of claim 14, wherein said cast-in-concrete is poured up to the road top if the road finish is concrete, and wherein said cast-in-concrete is poured to the top level of the pre-cast ring if the road finish is asphalt.

* * * * *